US007753679B1

(12) United States Patent
Schuetz

(10) Patent No.: US 7,753,679 B1
(45) Date of Patent: Jul. 13, 2010

(54) NON-FIRING TRAINING RIFLE

(76) Inventor: Brian D. Schuetz, 8520 Schuetz La., Olympia, WA (US) 98512

( * ) Notice: Subject to any disclaimer, the term of this patent is extended or adjusted under 35 U.S.C. 154(b) by 758 days.

(21) Appl. No.: 11/647,817

(22) Filed: Dec. 29, 2006

(51) Int. Cl.
*F41A 33/00* (2006.01)

(52) U.S. Cl. ..... 434/16; 42/49.02; 42/77; 89/29

(58) Field of Classification Search ..... 434/16; 42/77, 76.01, 49.02; 89/29
See application file for complete search history.

(56) References Cited

U.S. PATENT DOCUMENTS 4,058,922 A * 11/1977 Elbe et al. ..... 42/16
4,288,938 A * 9/1981 Kahn ..... 42/59
4,316,339 A * 2/1982 Herriott ..... 42/59
4,531,446 A * 7/1985 VanVoorhees ..... 89/29
4,648,192 A * 3/1987 Harness ..... 42/77
4,729,186 A * 3/1988 Rieger ..... 42/75.04
4,761,907 A * 8/1988 De Bernardini ..... 42/106
4,955,157 A * 9/1990 Brighton et al. ..... 42/77
4,969,283 A * 11/1990 Baehr ..... 42/70.01
H926 H * 6/1991 Mahtook ..... 89/128
5,228,887 A * 7/1993 Mayer ..... 42/75.02
5,740,626 A * 4/1998 Schuetz et al. ..... 42/106
5,937,563 A * 8/1999 Schuetz et al. ..... 42/106
6,289,620 B1 * 9/2001 Doria ..... 42/79
6,293,040 B1 * 9/2001 Luth ..... 42/75.01
6,625,916 B1 * 9/2003 Dionne ..... 42/16
6,701,909 B2 * 3/2004 Tiberius et al. ..... 124/74
6,769,209 B2 * 8/2004 Mendoza-Orozco ..... 42/77
6,789,342 B2 * 9/2004 Wonisch et al. ..... 42/75.02
6,869,285 B1 * 3/2005 Jones, II ..... 434/16
6,973,863 B1 * 12/2005 Jones ..... 89/14.2
7,036,260 B2 * 5/2006 Gee ..... 42/76.01
7,121,035 B2 * 10/2006 Greer ..... 42/77
7,302,881 B1 * 12/2007 Tertin ..... 89/128

* cited by examiner

*Primary Examiner*—Michael Carone
*Assistant Examiner*—Michael D David
(74) *Attorney, Agent, or Firm*—Brian J. Coyne

(57) ABSTRACT

A non-firing rifle that emulates a semi-automatic or automatic rifle for training in procedures for safe handling, cleaning, and field stripping of such weapons. The non-firing rifle retains the upper receiver assembly, barrel assembly, and ammunition magazine of the emulated rifle, as well as some of the components of the lower receiver assembly of the emulated rifle, but substitutes a modified forging for the lower receiver forging of the emulated rifle. Unlike the lower receiver forging of the emulated rifle, the modified forging has no cutouts to allow a trigger or hammer to be installed. A cutout is provided in a bottom wall of the forging, however, to allow installation of a pseudo-trigger. Accordingly, it is incapable of firing a live ammunition round.

14 Claims, 19 Drawing Sheets

NON-FIRING TRAINING RIFLE

CROSS-REFERENCE TO RELATED APPLICATIONS

None

STATEMENT REGARDING FEDERALLY APPROVED RESEARCH OR DEVELOPMENT

None

BACKGROUND OF THE INVENTION

1. Field of the Invention

This invention relates generally to training firearms and, in particular, to automatic and semiautomatic rifles that have been modified so as to be unable to fire ammunition, but which retain enough of the features of an original equipment rifle as to be useful in training military and police recruits in rifle cleaning, safety, and field stripping procedures.

2. Background Art

Military and police personnel, especially raw recruits, require introductory training in the use of firearms. Such training typically will include instruction on safe handling and storage, as well as procedures for cleaning, and field stripping, of such weapons. In the interest of safety, training firearms for this purpose desirably are incapable of firing a lethal round, or of firing any round at all. It is still more desirable to provide for training and familiarization, a standard firearm with minimal modification to make it non-firing, whereby all the procedures ordinarily followed with the standard form of the firearm can be performed on the modified firearm.

U.S. Pat. No. 5,937,563 to Schuetz disclosed a firearms safety system for adapting conventional handheld firearms to fire non-deadly simulated training ammunition. The system provides a series of gas relief ports and passages to prevent the successful firing of live ammunition in the firearm.

U.S. Pat. No. 4,969,283 to Baehr disclosed a firearm having live round inhibiting means mounted in the barrel of the firearm, which permitted a blank cartridge to be loaded into a firearm and fired while preventing the loading and firing of a live round.

U.S. Pat. No. 6,625,916 to Dionne disclosed a conversion of firearms to fire reduced-energy ammunition. A training kit was provided for use with a firearm that normally has a standard bolt, which standard bolt had a bolt recess at a forward end thereof for receiving and embracing the head end of a standard cartridge. The training kit included, in addition to round of reduced-energy training ammunition, a training bolt with a circular recess of a diameter that would not receive and embrace the head end of the standard cartridge; this limited the placement of a standard cartridge beyond the reach of the firing pin.

To prevent inadvertent placement of a live round into a firearm equipped with a laser for use in laser tag training exercises (the Multiple Integrated Laser Engagement System or "MILES"), U.S. Pat. No. 7,036,260 to Gee disclosed a safety system for safely venting through a succession of vent holes in the barrel the pressure needed to propel a bullet down and through the barrel. If a live round were inadvertently loaded, the bullet would be retained in the bore and the firearm would shut down.

U.S. Pat. No. 6,973,863 to Jones disclosed an adaptor for use with a flash suppressor on a machine gun barrel that developed sufficient back pressure in order to allow the gun to repeatedly fire blank rounds of ammunition.

U.S. Pat. No. 6,701,909 to Tiberius et al. disclosed a semi-automatic-firing compressed gas gun for firing paintballs. The gun was sized and designed to appear like and operate in a manner similar to a conventional gun.

U.S. Pat. No. 6,869,285 to Jones, II disclosed a training firearm that provided a realistic recoil effect. A laser replaced live rounds, and a blow back assembly was provided that was driven by a disposable cartridge of compressed gas that was self-contained in the gun handle. A valve integrated with the firing pin released a burst of gas when the firing pin was impacted by the hammer. The gas pushed back a slide and recocked the hammer for the next round.

SUMMARY OF THE INVENTION

According to the present invention, a non-firing training rifle is provided by modification to an original equipment, manually operated, semiautomatic or automatic rifle of the kind that includes a lower receiver assembly, an upper receiver assembly housing a bolt carrier assembly and a charging handle, a barrel assembly, and an ammunition magazine insertable into the magazine well of the lower receiver assembly. This is achieved by modifications that are limited just to changes in the lower receiver assembly and, preferably, to a change in the rifle barrel also. In this manner, the training rifle, although incapable of firing a live round, has the look, feel and operability as near as possible to the original equipment rifle that it emulates. Of particular importance for training purposes, the following operations, when performed on the training rifle, are identical to those performed on the original equipment rifle that it emulates: rifle disassembly, cleaning, and reassembly; operation of the safety selector; attachment and disattachment of a bayonet; insertion and removal of an ammunition magazine; and height adjustment of the rear sight.

For the original equipment lower receiver assembly is substituted a modified lower receiver assembly that eliminates the firing chamber and eliminates the hammer. Whereas a rear portion of an original equipment lower receiver is open at the top to permit the hammer, when actuated by a trigger assembly, to strike a firing pin within the upper receiver portion so as to cause the firing pin to impact an ammunition cartridge within the firing chamber and thereby fire a bullet, the modified lower receiver assembly of the present invention has a flat top wall located there instead. Thus, the training rifle is incapable of firing a live round. Preferably, for the standard equipment rifled gun barrel is substituted a smooth bore rifle barrel, which saves the unnecessary time and expense of rifling the gun barrel.

Figure 1:
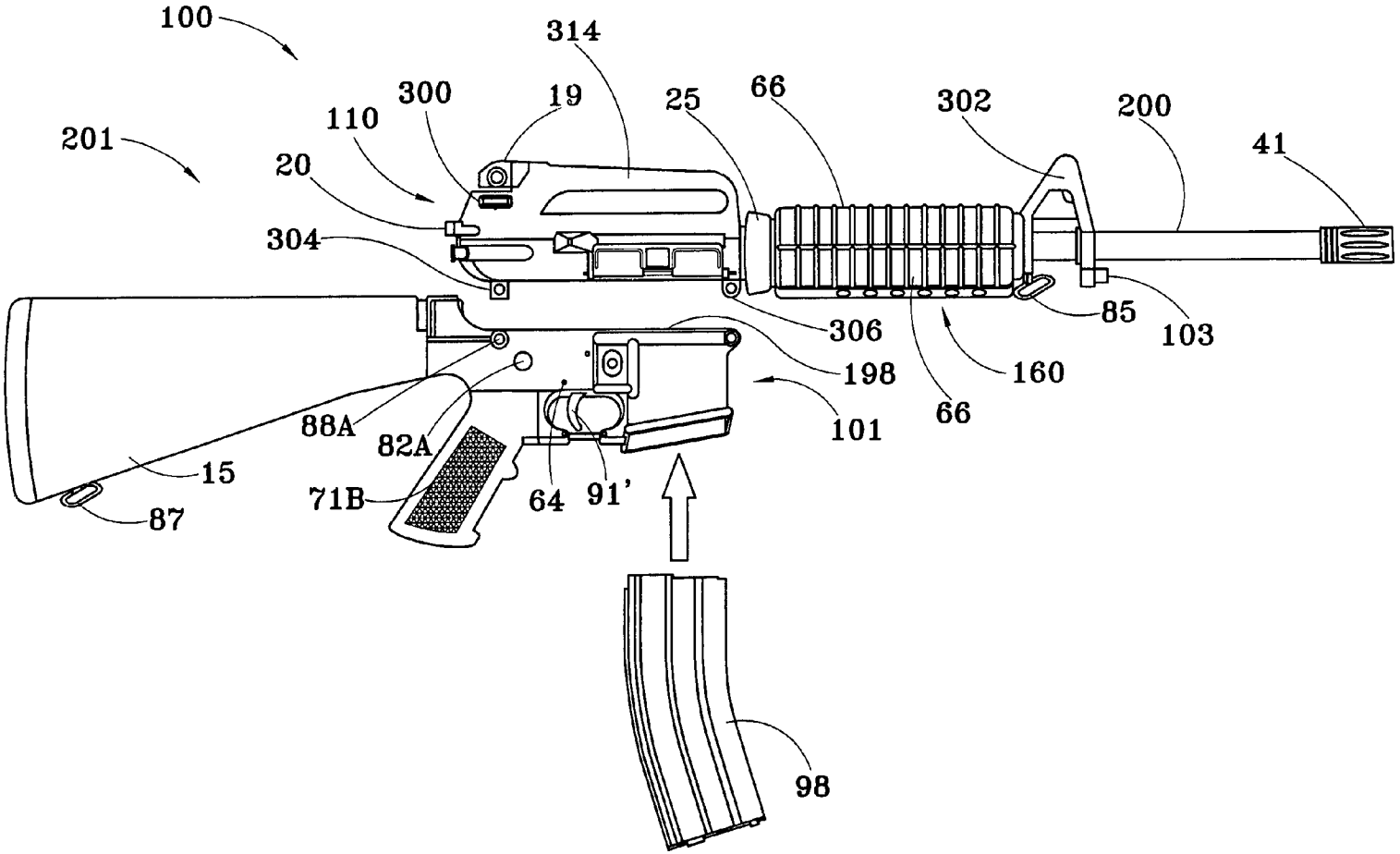
FIG. 1 is a right side elevational view of the training rifle of the present invention that emulates an M-16 rifle, wherein, for clarity, the sling has been removed and the upper receiver assembly (with attached barrel assembly) and the ammunition magazine are shown disattached from the lower receiver assembly, but aligned and oriented preparatory to attachment to the lower receiver assembly.

As used herein, the terms "left," "right," "top," and "bottom" refer to the left, right, top and bottom portions, respectively, of the training rifle as they would appear to a trainee who is holding it against his body in a ready-to-aim position. The terms "front" and "rear" refer to the right and left portions of the training rifle, respectively, as depicted in FIG. 1, and the term "forward direction" denotes a direction away from the buttstock and toward the front of the training rifle. Similar numerals denote similar components of the invention throughout the several figures.

DESCRIPTION OF THE PREFERRED EMBODIMENT

Figure 2:
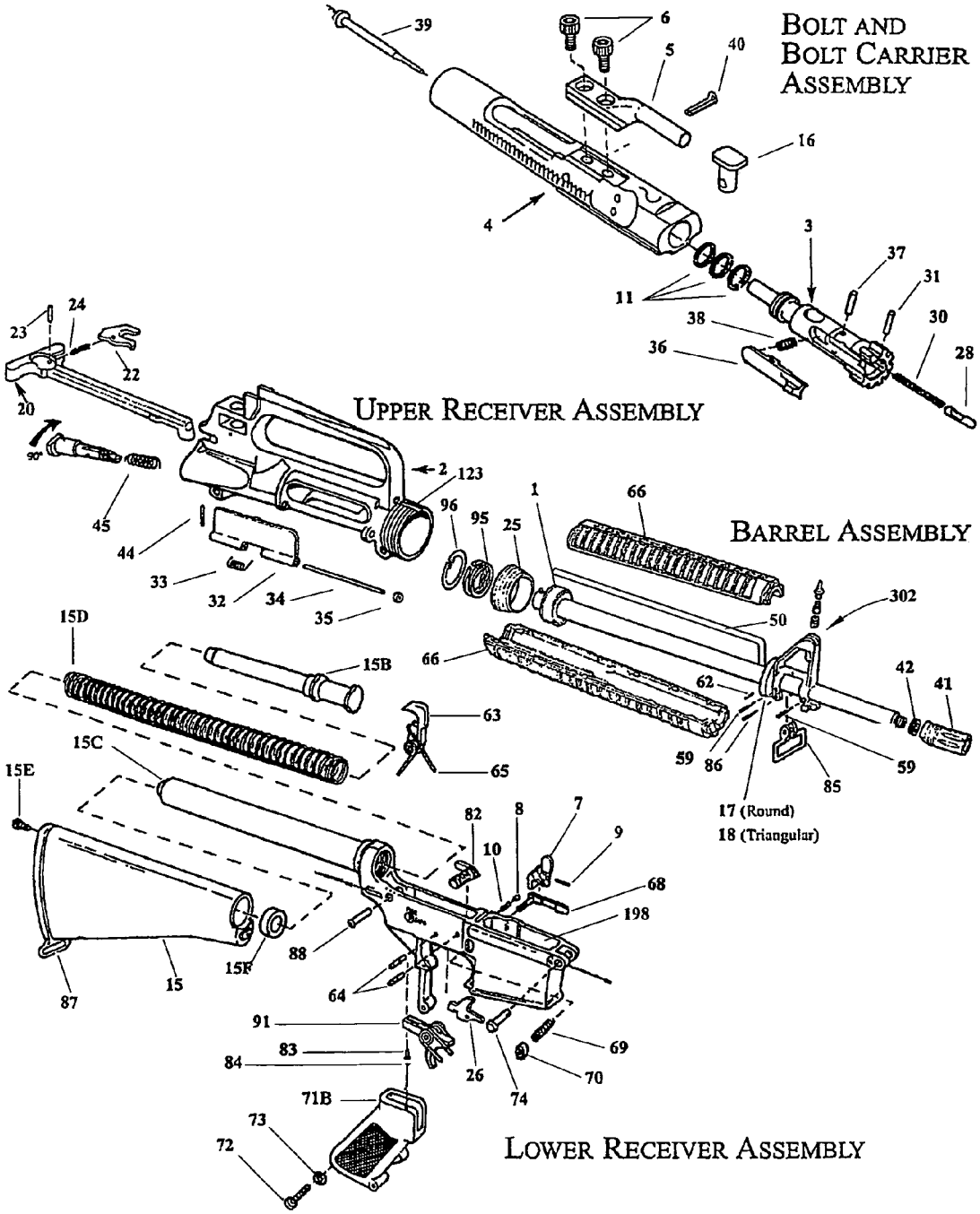
FIG. 2 (Prior Art)
FIG. 2 depicts in exploded view the bolt and carrier assembly, upper receiver assembly, barrel assembly and lower receiver assembly of an unmodified, prior art M-16 rifle.
Figure 3:
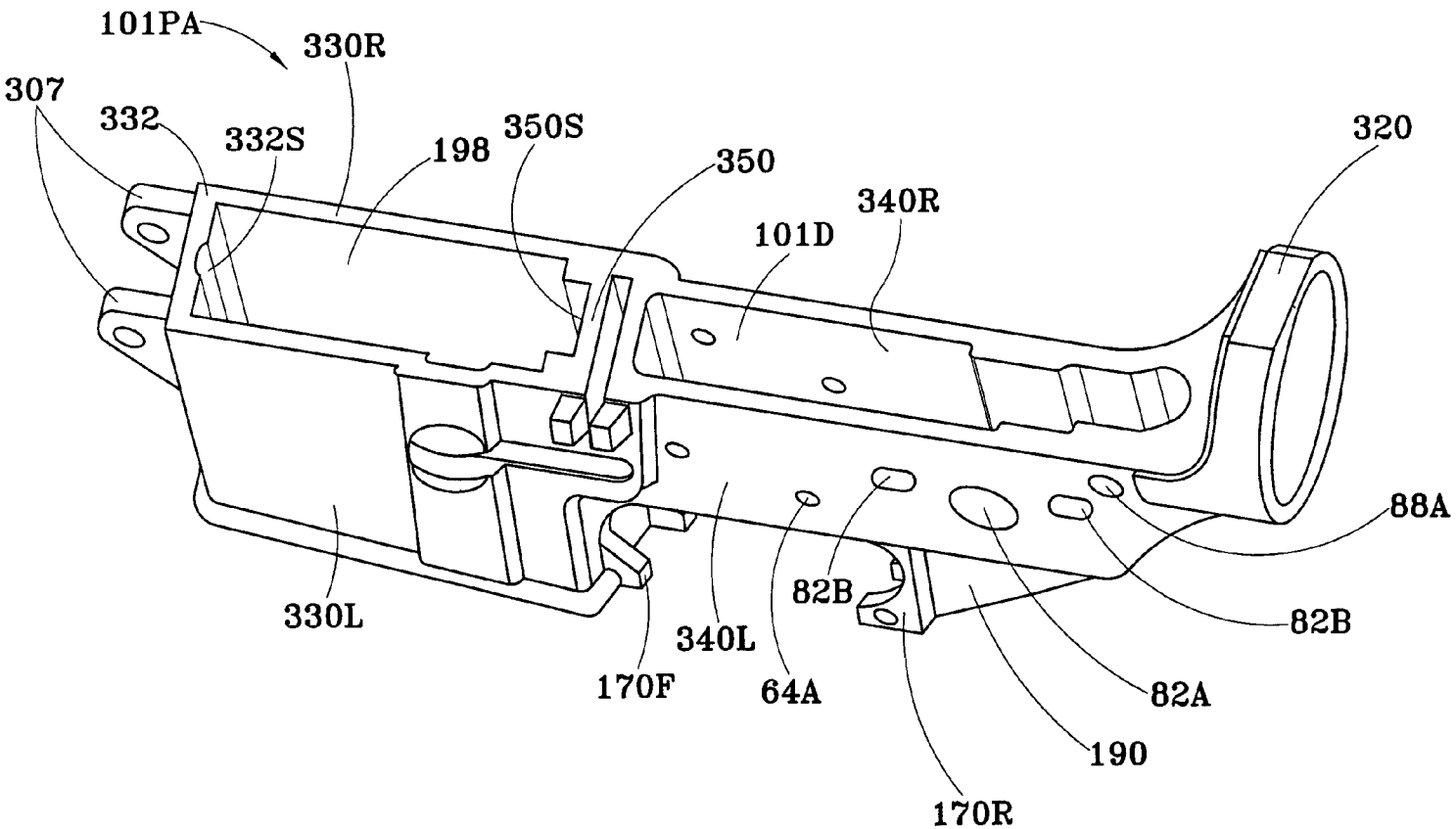
FIG. 3 (Prior Art)
FIG. 3 is a left side, top perspective view of a lower forging thereof, removed and stripped.

Referring to FIG. 1, the non-firing training rifle 100 of the present invention is shown partially disassembled and in right side elevational view, and may be seen to comprise an upper receiver assembly 110 with an attached barrel assembly 160, a substitute lower receiver assembly 201 and an ammunition magazine 98. M-16 is the U.S. military designation for a family of rifles derived from the Armalite AR-15 rifle and further developed by Colt Industries of Hartford, Conn., starting in the mid-20th century. It has been the primary infantry rifle of the United States military since the 1960s. Accordingly, for illustrative purposes, the non-firing training rifle 100 herein described emulates an M-16 rifle; but, it will be understood that the training rifle 100 can be altered within the scope of the appended claims in ways known to persons of ordinary skill in the art of manufacture of semi-automatic and automatic rifles in order to emulate other semi-automatic and automatic rifles. The upper receiver assembly 110, barrel assembly 160, and ammunition magazine 98 are standard equipment components of the original equipment rifle that the training rifle 100 emulates, and thus, for the training rifle 100 described and illustrated here, are standard equipment components of an M-16 rifle, as illustrated in FIG. 2; provided that, unlike the rifled barrel of an M-16 rifle, the barrel 200 of the training rifle 100 preferably has a smooth bore. As depicted in FIG. 1, the upper receiver assembly 110, with attached barrel assembly 160, has been disattached from the lower receiver assembly 201 by removal of the rear takedown pin 88 from an apertured takedown pin lug 304 that depends from a rear, bottom end of the upper receiver assembly 110 and from a rear takedown pin aperture 88A in the lower receiver assembly 201, and further, by removal of the front pivot pin 74 from a transversely spaced-apart pair of apertured lugs 307 that extend forwardly from a front end of the lower receiver assembly 201 as well as from an apertured lug 306 that depends from a front, bottom end of the upper receiver assembly 110 and is adapted for insertion between the lugs 307.

Figure 7:
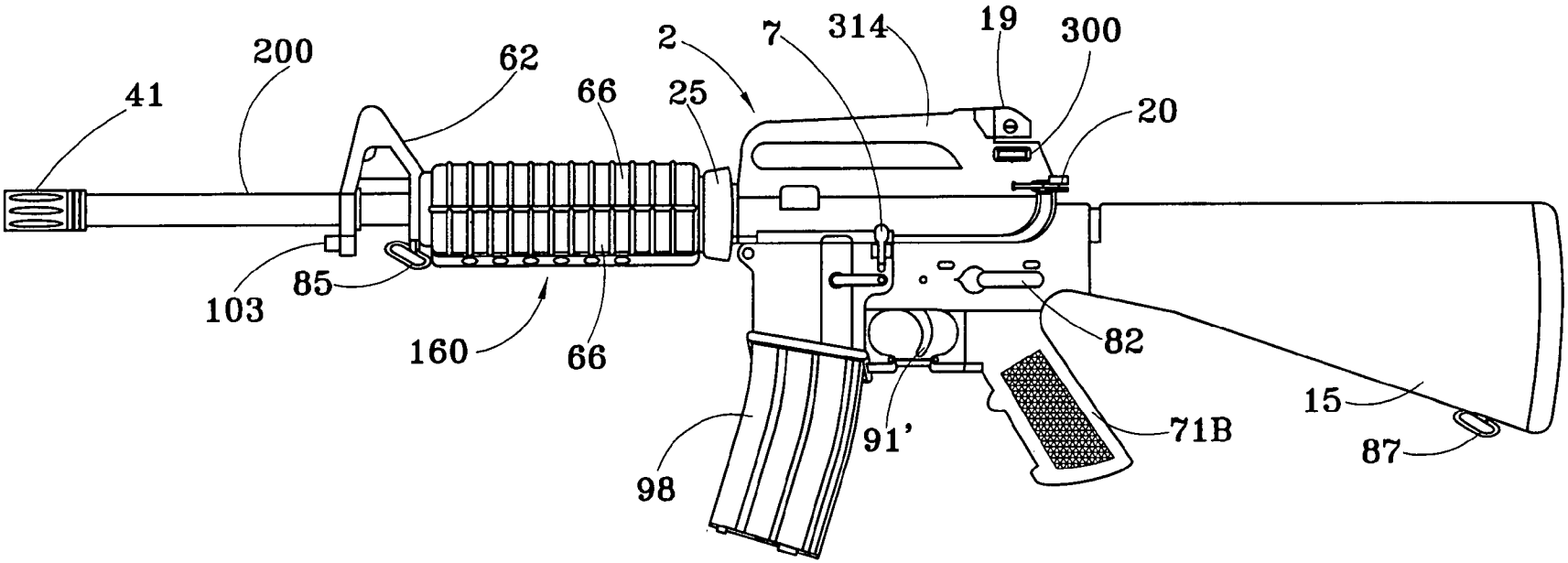
FIG. 7 is a left side elevational view of the training rifle of the present invention that emulates an M-16 rifle.
Figure 8:
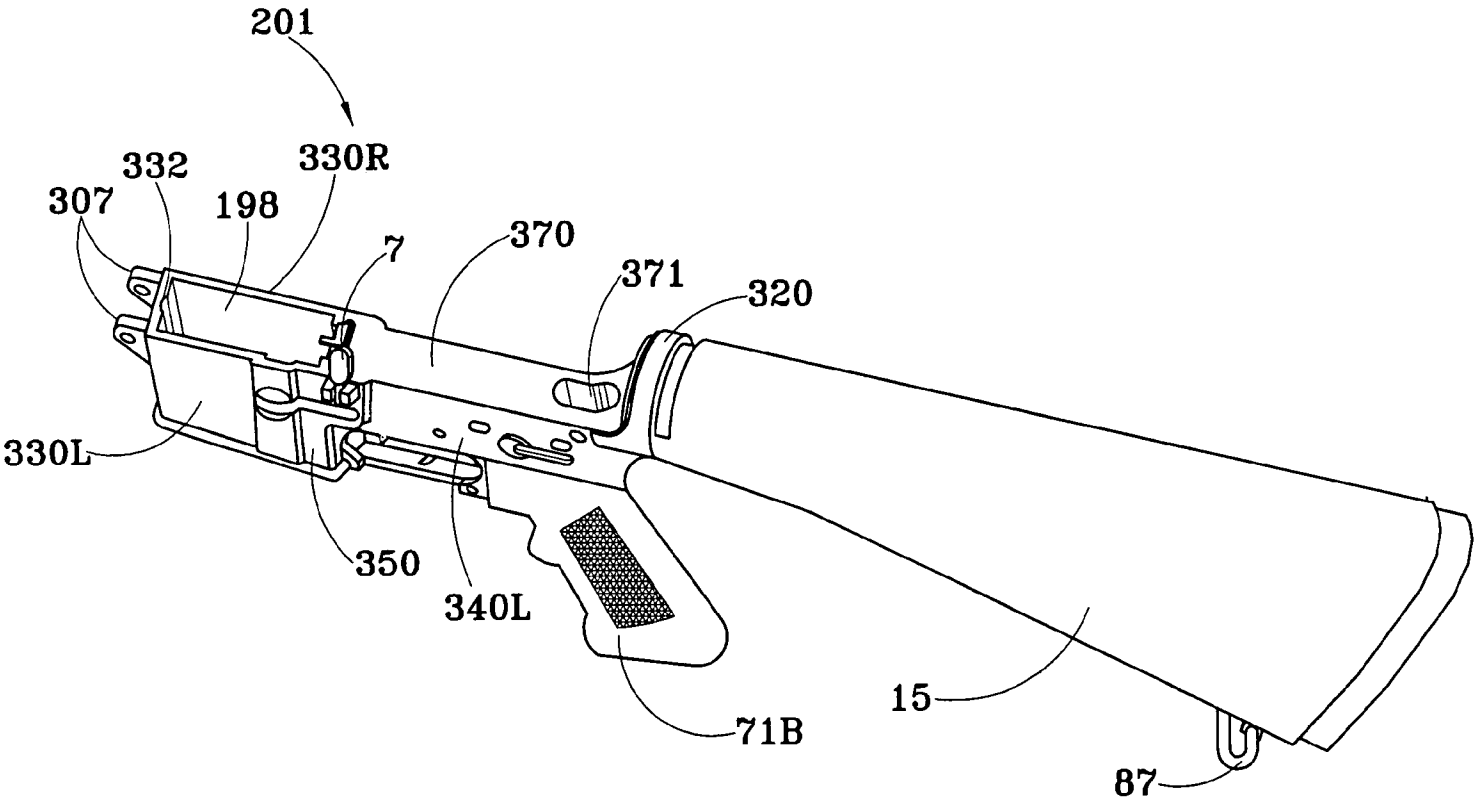
FIG. 8 is a top, left side perspective view of the lower receiver assembly thereof.
Figure 9:
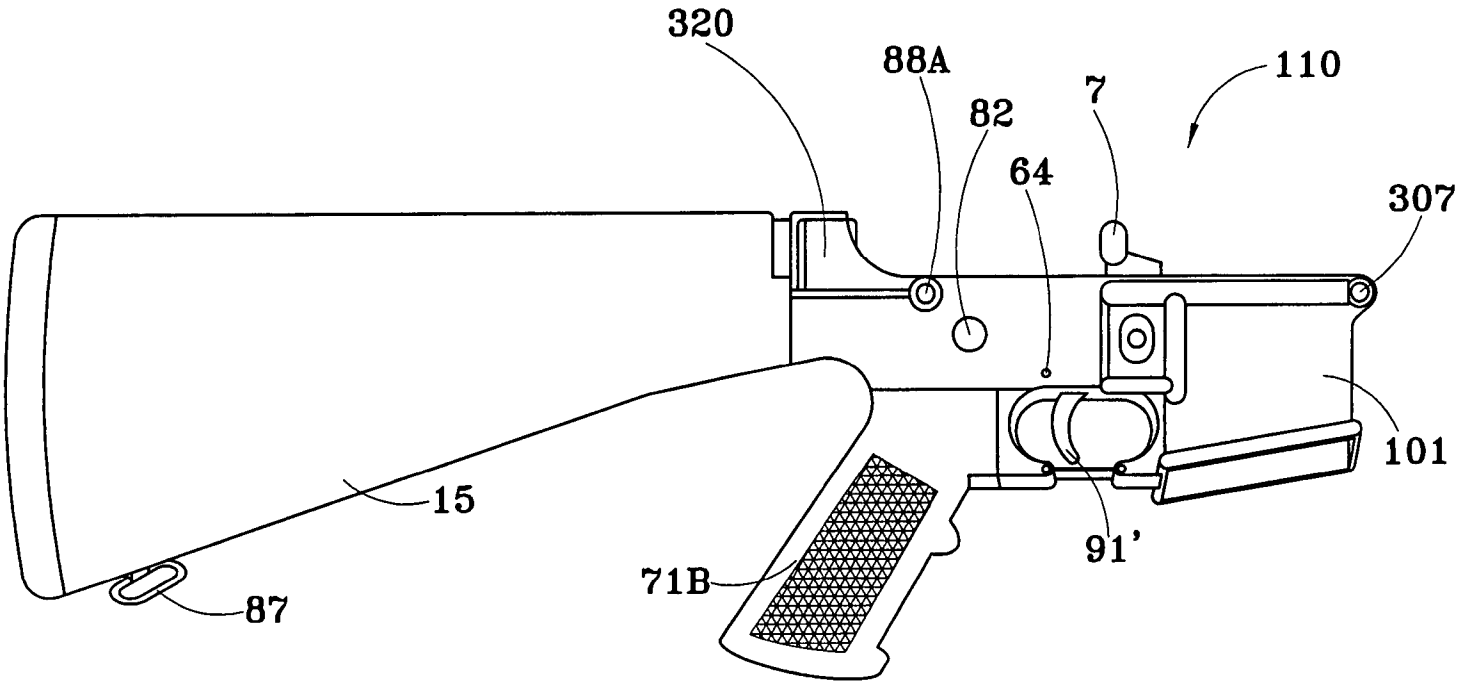
FIG. 9 is a right side elevational view thereof.

The training rifle 100 is further depicted fully assembled in left side elevational view in FIG. 7 with the ammunition magazine 98 inserted into the magazine well 198 of the lower receiver assembly 201. Attached to the barrel 200 in the normal manner are a flash suppressor 41, delta ring assembly 302, upper and lower handguards 66, and a barrel nut 25 with internal thread for threaded attachment to a front end of the upper receiver assembly 110. The delta ring assembly 302 includes a front sight 308, and depending from the delta assembly are a bayonet lug 103 and front sling swivel 85. Inserted within a longitudinally-extended tubular housing 310 of the upper receiver assembly 110 are a bolt and bolt carrier carrier assembly, overlying which is a charging handle 20 supported within a longitudinally-extended track 312, all as depicted in FIG. 2. Extending upward from the track 312 is a carrying handle 314. A rear sight 19 is incorporated into a rear portion of the handle 314, which includes a screw height adjustment 300. All these components of the barrel assembly 160 and upper receiver assembly 110 are standard equipment on an M-16 rifle, depicted in FIG. 2.

The lower receiver assembly 201 of the training rifle 100 comprises some, but not all, of the components of an M-16 lower receiver assembly as depicted in FIGS. 2-6. Retained within the lower 201 assembly of the training rifle 100 are the original equipment pistol grip 71B, buttstock 15, receiver extension 15C, buttstock buffer 15B, buffer spring 15D, stock spacer 15F, buffer detent 12, buffer detent spring 13, safety selector 82, safety detent 83, safety spring 84, front pivot pin 74, rear takedown pin 88, bolt catch 7, magazine catch 68, magazine catch spring 69, magazine catch button 70, ejection cover 32, ejection cover spring 33, ejection cover hinge plate 34, ejection cover hinge pin clip 35, and trigger pin 64. Eliminated from the training rifle 100 are the following components of an M-16 lower receiver assembly: trigger 91, hammer 63, hammer pin 64, and hammer spring 65. A pseudo-trigger 91' is substituted for the trigger 91. The original equipment trigger 91 has a front, lever end 91F that engages a hammer 63 and a rear, lever end 91R that engages the safety selector 82 within the cutout 101C of the prior art forging 101PA, but these features are preferably eliminated in the pseudo-trigger 91' as unnecessary. Substituted for the original equipment lower receiver forging 101PA, as depicted in FIGS. 2-6, is a modified lower receiver forging 101 to which the aforementioned retained components are attached in a manner identical to the way they are attached to the original equipment lower receiver forging 101PA. The forging 101 is preferably fabricated of forged aluminum, but other suitable substances and fabrication methods could be employed to make this component of the training rifle 100.

Figure 4:
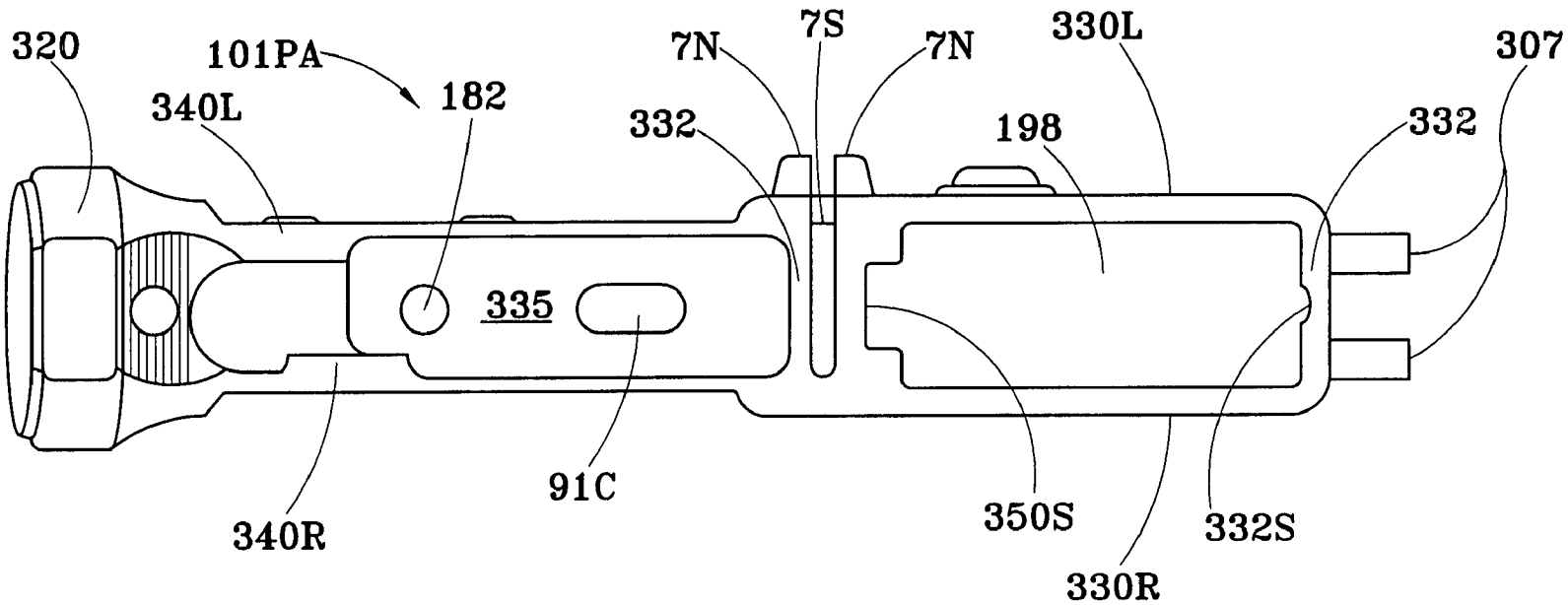
FIG. 4 (Prior Art)
FIG. 4 is a top view thereof.
Figure 5:
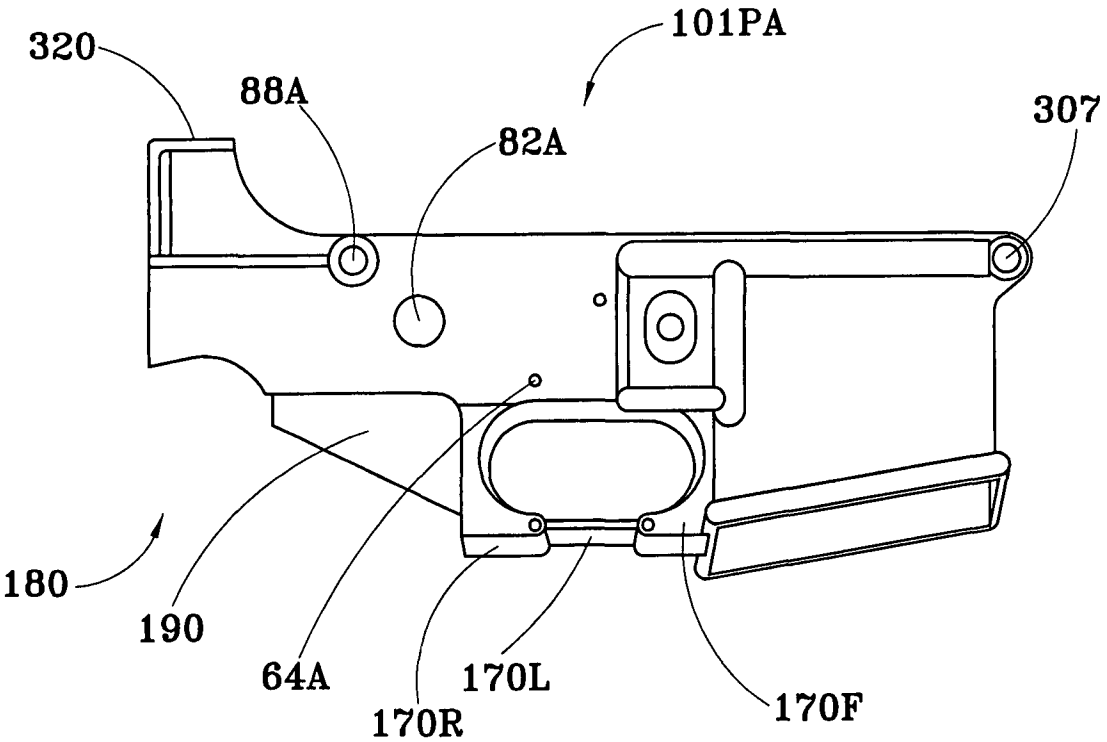
FIG. 5 (Prior Art)
FIG. 5 is a right side elevational view thereof.
Figure 6:
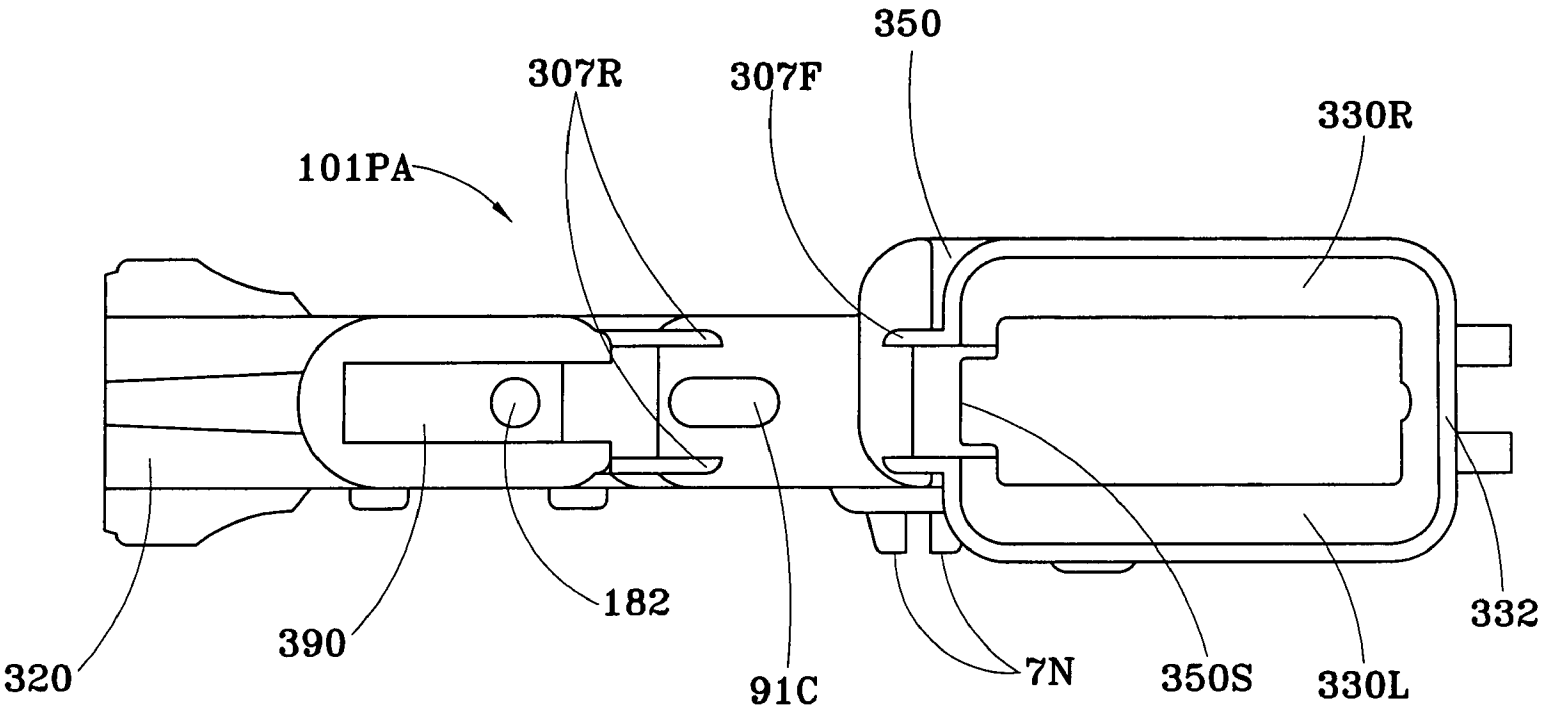
FIG. 6 (Prior Art)
FIG. 6 is a bottom view thereof.

The modified structure of the substituted lower receiver forging 101, as depicted in FIGS. 8, 9, 10A, 10B and 10C, should be compared with the prior art lower receiver forging 101PA as depicted in FIGS. 2-6. It may be seen that both versions extend longitudinally from a rear end to a front end and include a rear portion 101R comprising buttstock attachment means by which the forging is attached to a front end of the buttstock 15, which means includes an upstanding, internally threaded ring 320 having an internal diameter slightly greater than the diameter of the buffer 15 for mating engagement with the external thread on a front end portion of a receiver extension 15C. Both versions have a front portion 101F comprising spaced-apart, vertical left and right walls 330L, 330R of equal size joined by a first vertical front wall 332, and a central portion 101C intermediate the rear and front portions, said central portion including longitudinally-extended left and right walls 340L, 340R of equal size joined by a second vertical front wall 350, a bottom wall 360 and the buttstock attachment means 320. In the prior art lower receiver forging 101PA, the central portion 101C has a top cutout 101D so that it is open at the top to permit the hammer 63 to strike the firing pin 39 when the trigger 91 is pulled. In the lower receiver forging 101 of the training rifle 100, the central portion 101C includes a flat, longitudinally-extended horizontal top wall 370 that joins the upper margins of the left wall 340L and the right wall 340R, and a flat bottom wall 335 that joins lower margins of the same walls, whereby the central portion 101C fully encloses an interior space, except for an opening 371 in a rear end portion of the top wall 370 adapted to receive the takedown pin lug 304 of the upper receiver assembly 110, and except for a pseudo-trigger access cutout 91C in the bottom wall 335, which bottom wall 335 and cutout 91C are identical to those of the prior art forging 101PA as depicted in FIG. 4, the cutout 91C being only somewhat larger in the training rifle 100 compared to that of the prior art M-16 rifle. Thus, the cutout 101D of the prior art forging 101PA is eliminated in the substitute forging 101, but the bottom wall 335 and trigger access cutout 91C are retained. Suitable apertures are provided in the left and right walls 340L, 340R of the central portion 101D for mounting a magazine catch button 70, a trigger pin 64, a safety selector 82, and for receiving the rear takedown pin 88. At a front end of the substitute lower receiver forging 101, apertured lug extensions 307 are provided for attachment of a front end of the upper receiver assembly 110 to a front end of the lower receiver forging 101 by front pivot pin 74. As in the prior art lower receiver forging 101PA, the front portion 101F includes a magazine well 198 into which an ammunition magazine 98 is insertable. The magazine well 198 is a space defined by the left and right walls 330L, 330R joined by the walls 332, 350. Interior surfaces of the walls 332 and 350 have vertical slots 332S and 350S, which complementarily engage front and rear walls of an inserted ammunition magazine 98, respectively. An upper end of the wall 350 has a transverse slot 7S and an exterior surface of the left wall 340L of the central portion 101C has as a pair nibs 7N, which, in combination, are adapted to receive and mount a bolt catch 7 to the lower receiver forging 101. Depending from the central portion 101C is a trigger guard, which is identical to the trigger guard of the prior art lower receiver forging 101PA, and comprises a front guard member 170F with an arcuate rear surface and a rear guard member 170R with an arcuate front surface joined at their lower ends by a straight, flat lower member 170L. Integral with, and rearward of, the rear guard member 170 is means 180 for attaching an upper portion of the pistol grip 71B to a lower portion of the lower receiver forging 101; said means includes a longitudinally-disposed plate 190 that depends from the bottom wall 360 of the central portion 101C, and which appears substantially trapezoidal in left and right side elevational views. The plate 190 is complementary to, and is received by, a recess 184 in an upper end portion of the pistol grip 71B and has an internally-threaded aperture 182 for attachment to the pistol grip 71B by a threaded bolt 72, as depicted in FIG. 2. Thus, the means of attachment of the pistol grip 71B to the lower receiver forging 101 is identical to that of the prior art M-16 rifle.

Figure 10A:
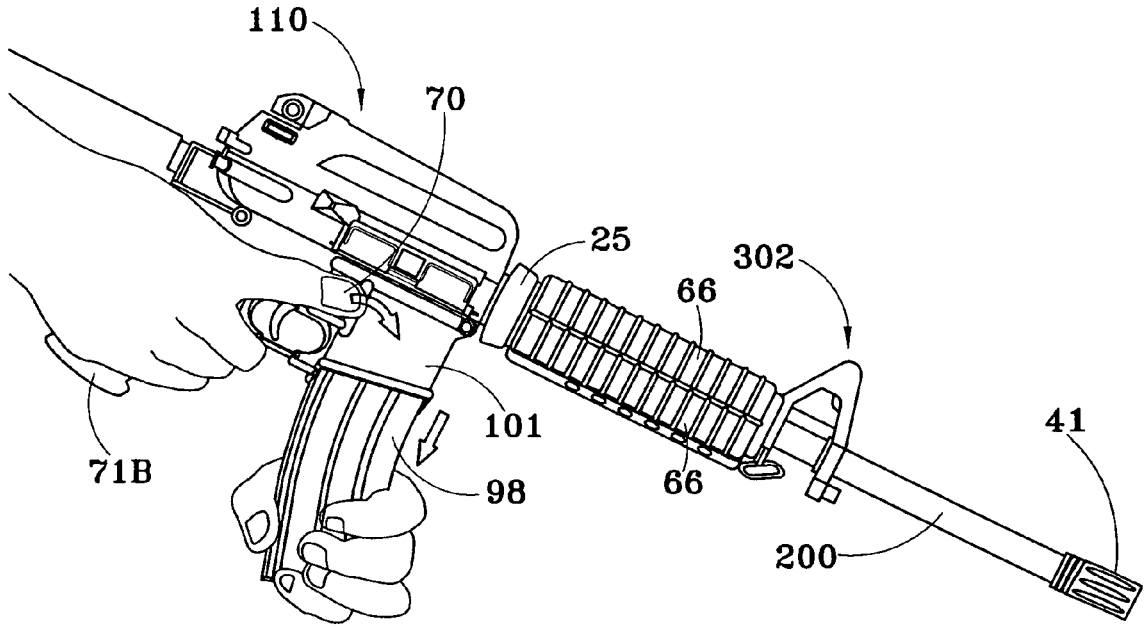
FIG. 10A depicts a trainee disattaching an ammunition magazine from the training rifle.
Figure 10B:
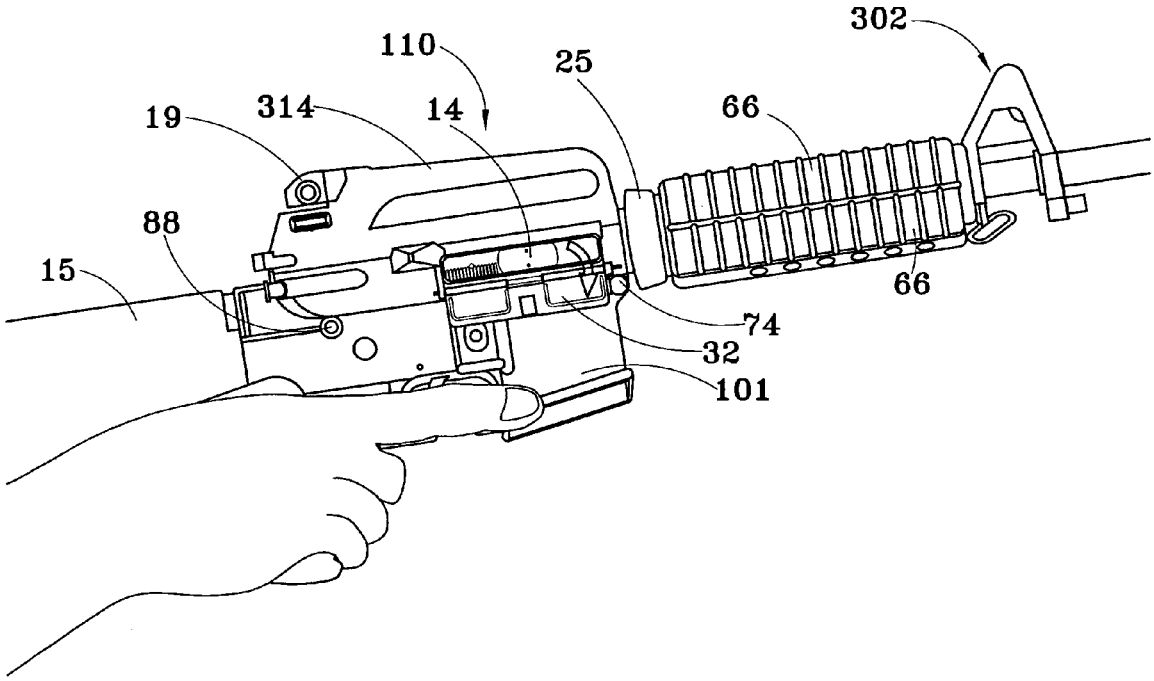
FIG. 10B depicts a trainee visually checking that the firing chamber is clear.
Figure 10C:
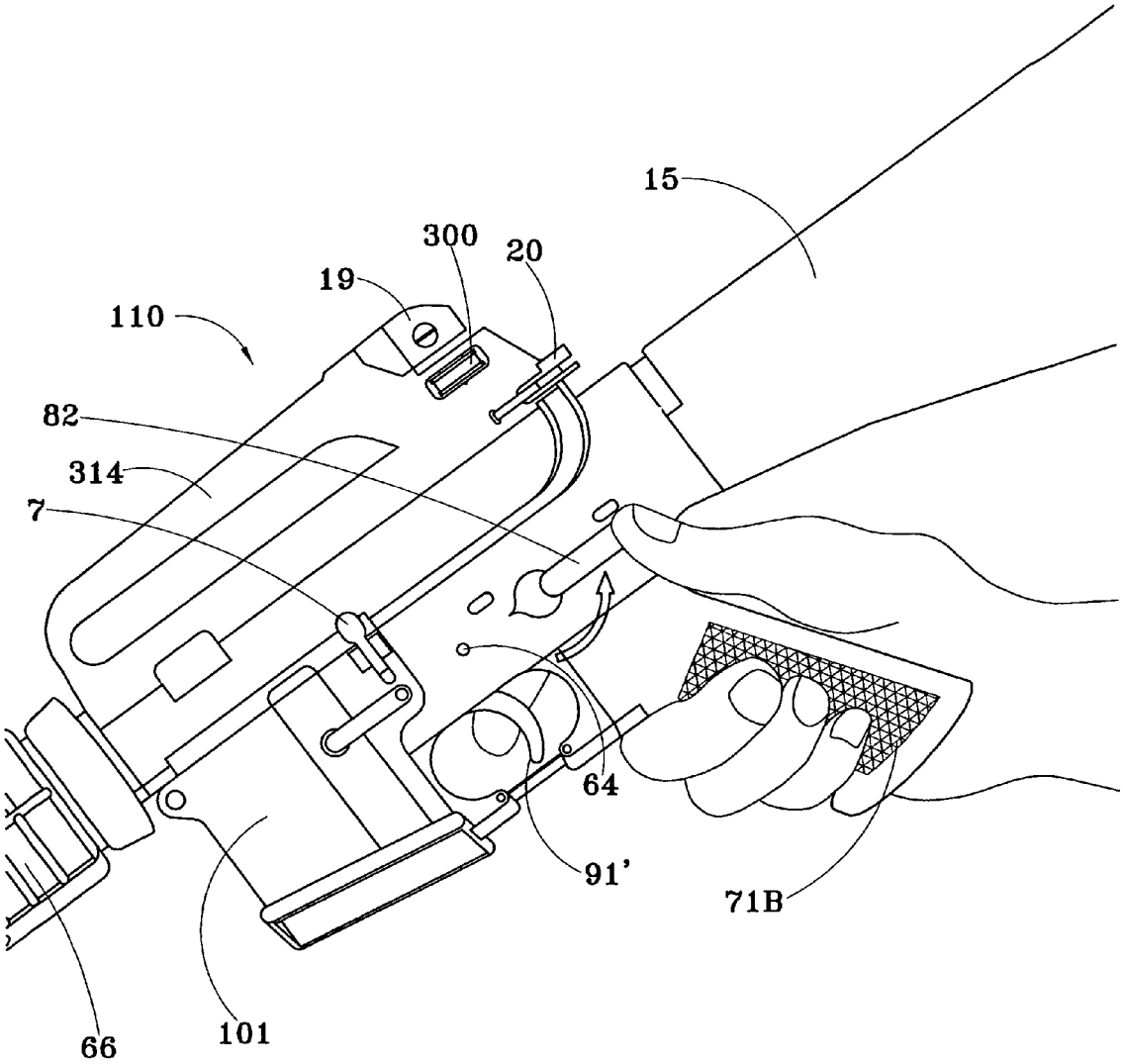
FIG. 10C depicts a trainee, after finding that the firing chamber is clear, putting the safety selector to the "Safe" position.

The training rifle 101 may be used to demonstrate and to practice rifle clearing, cleaning, safety, and field stripping procedures. The procedure to check that the firing chamber is clear is as follows. The ammunition magazine 71B is removed by pressing the magazine catch button 70 and pulling the magazine out of the magazine well 198; FIG. 10A. The rifle muzzle is placed into a cleaning barrel; if one is not available, the muzzle is pointed into the air. The charging handle 20 is pulled back, and the bottom of the bolt catch 7 is pressed to lock the bolt 3 to the rear. With the ejection cover hinge plate 34 open, the firing chamber is visually checked through the ejection port 14 to see whether the firing chamber is clear; FIG. 10B. If the firing chamber is clear, the safety selector is then moved to the "Safe" position; FIG. 10C.

Figure 11A:
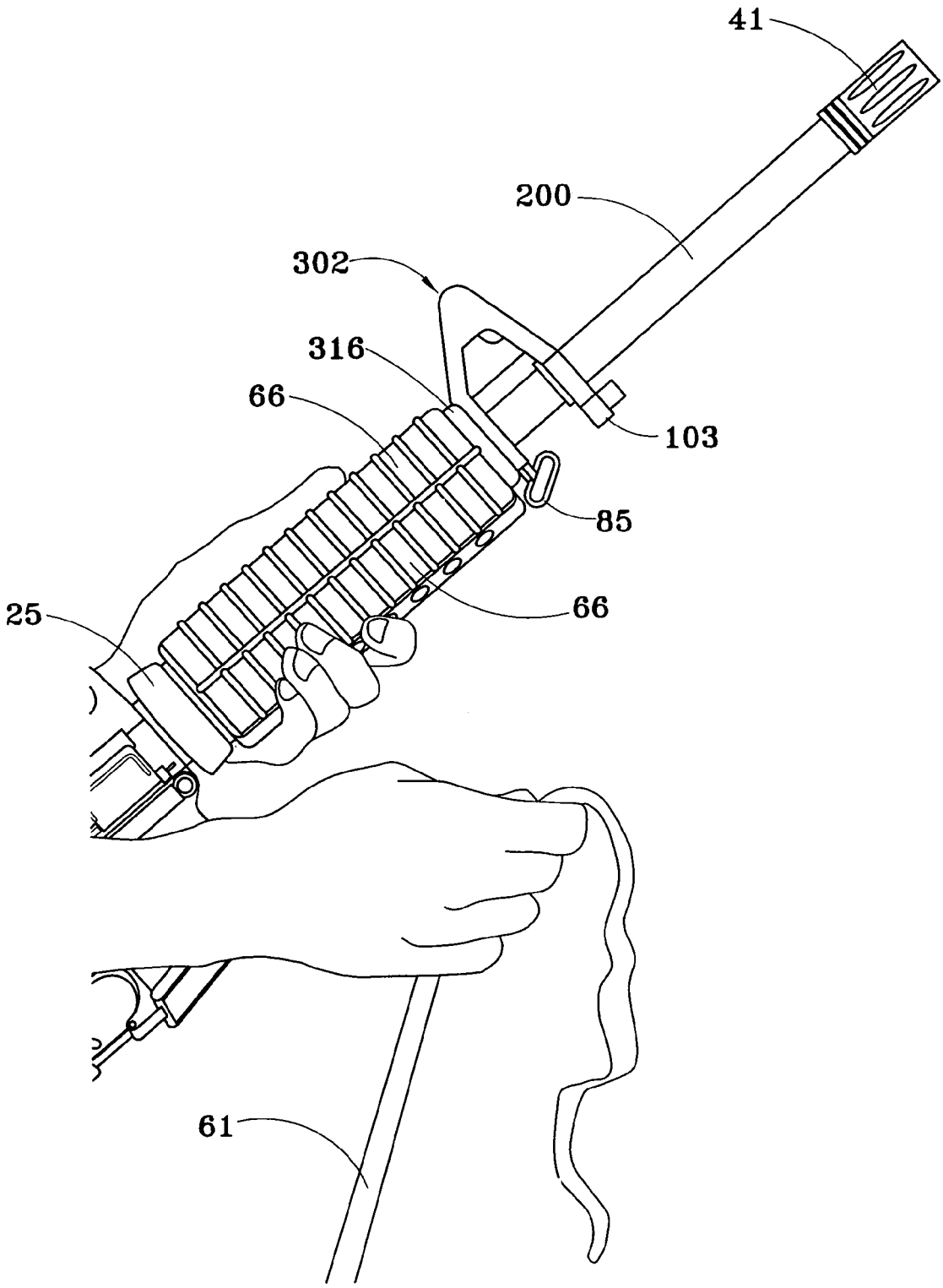
FIG. 11A depicts a trainee removing the strap of the sling from the training rifle.
Figure 11B:
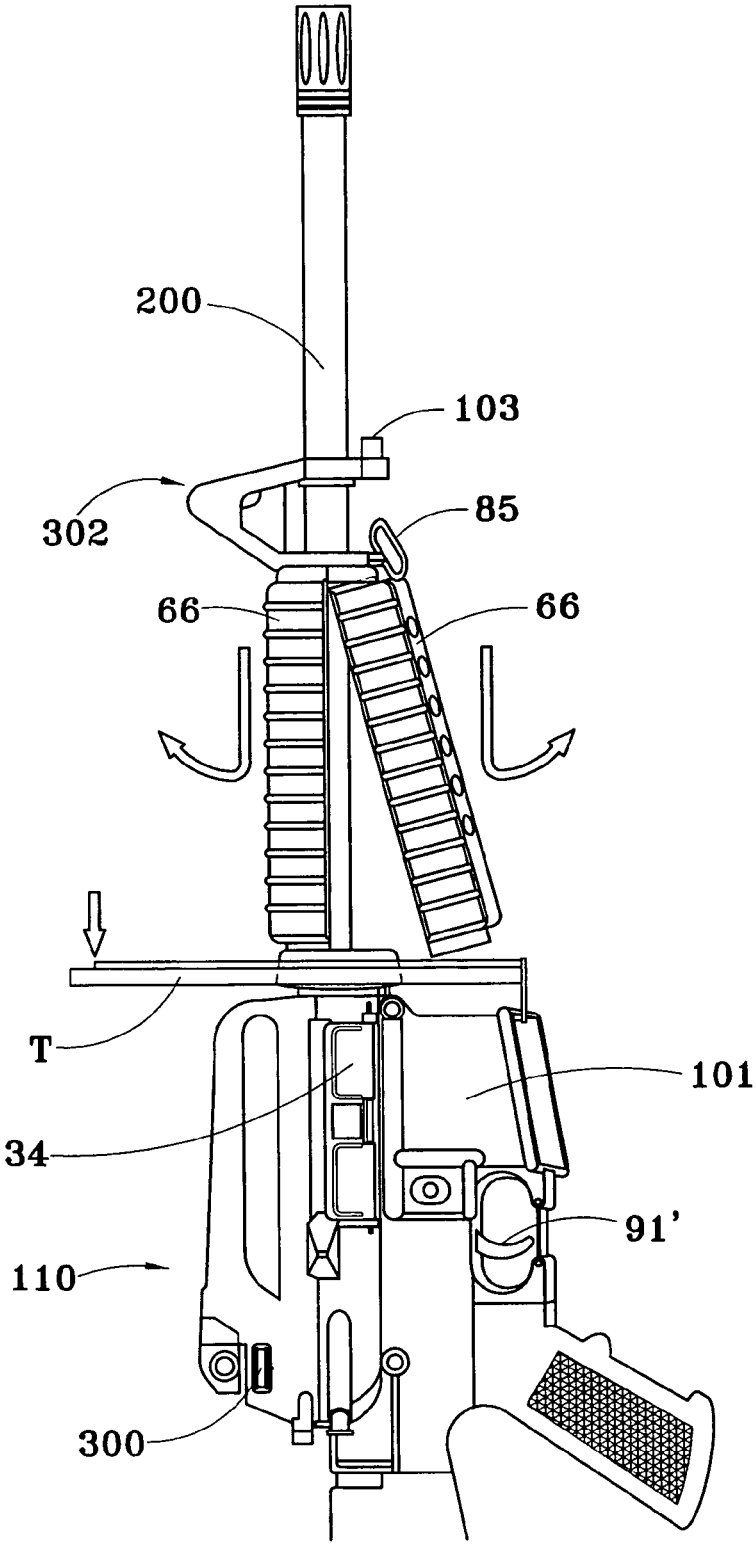
FIG. 11B depicts a trainee removing the handguards from the training rifle.
Figure 12A:
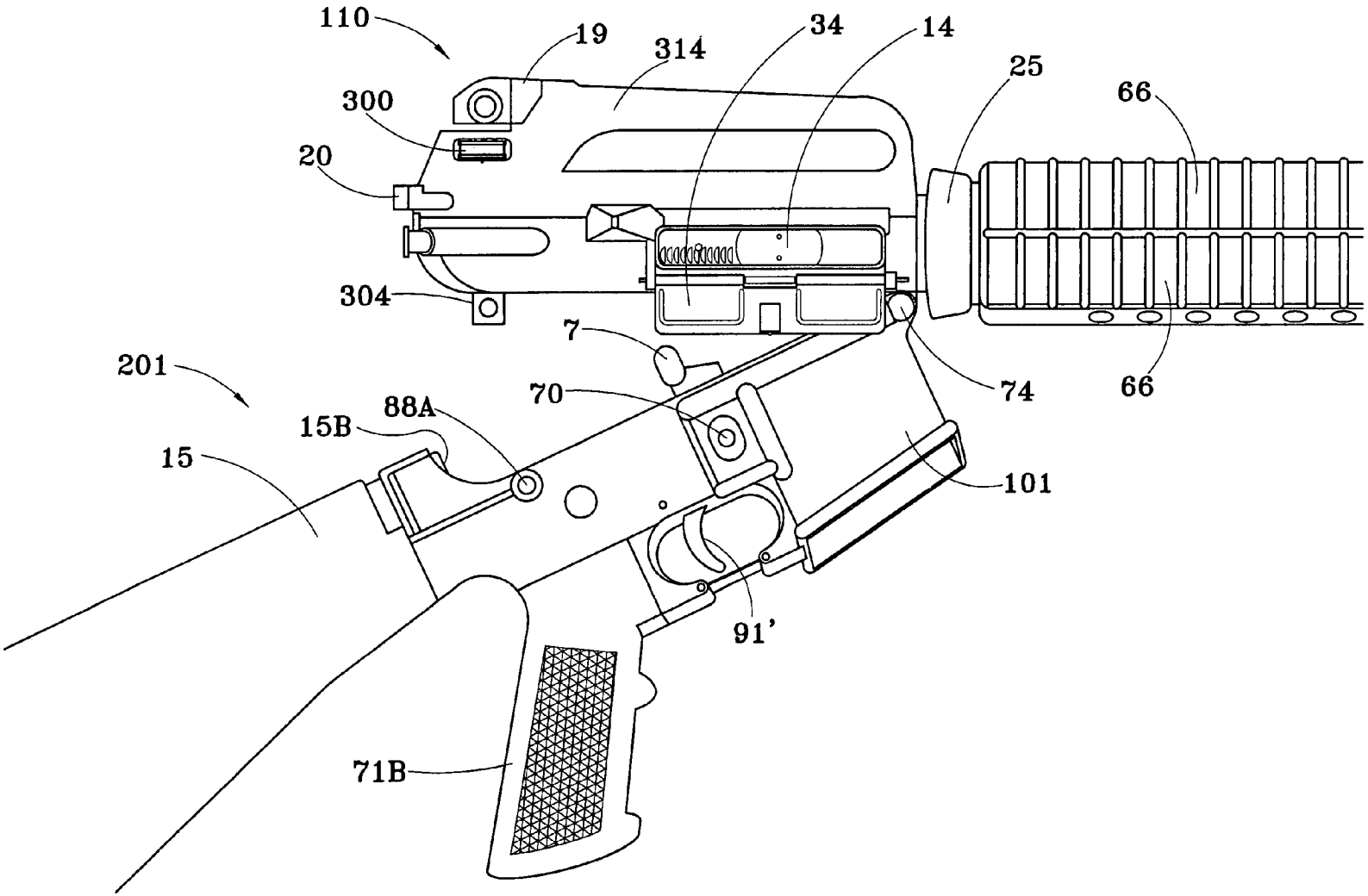
FIG. 12A is an enlarged, fragmentary, right side elevational view of the training rifle, and the upper receiver assembly has been pivoted away from the lower receiver assembly, as an initial step in field stripping the training rifle.
Figure 12B:
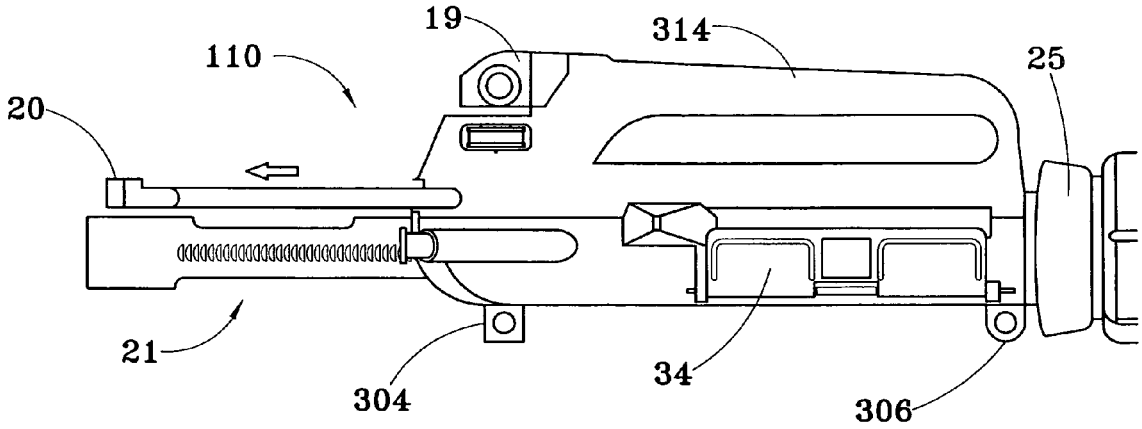
FIG. 12B depicts partial removal of the charging handle and carrier bolt assembly therefrom.
Figure 12C:
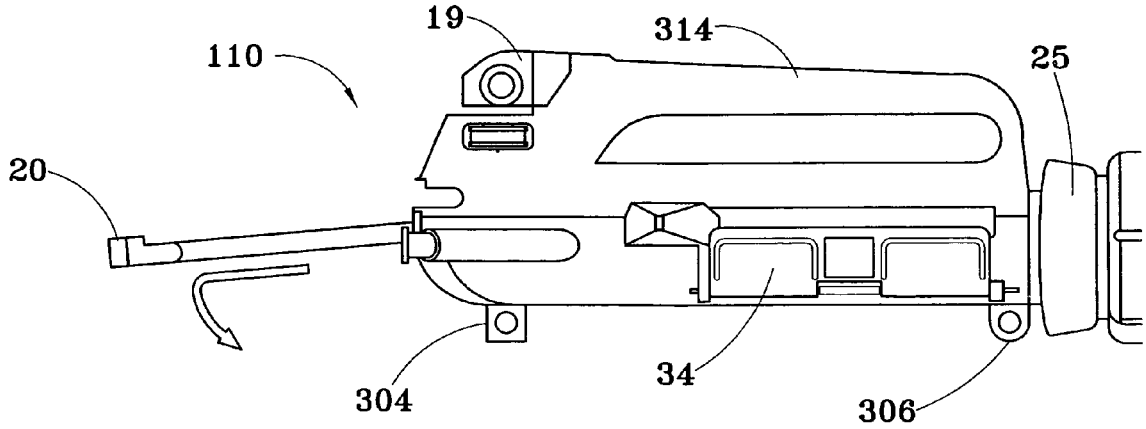
FIG. 12C depicts a trainee lowering the charging handle thereof out of its track, as further steps in field stripping the training rifle.
Figure 13A:
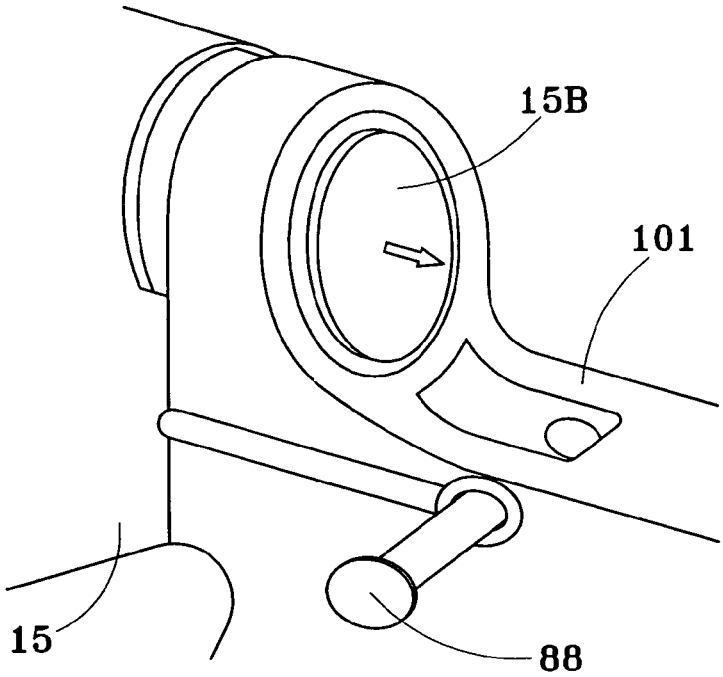
FIG. 13A depicts a trainee releasing the buffer and buffer spring from the extension tube of the training rifle.
Figure 13B:
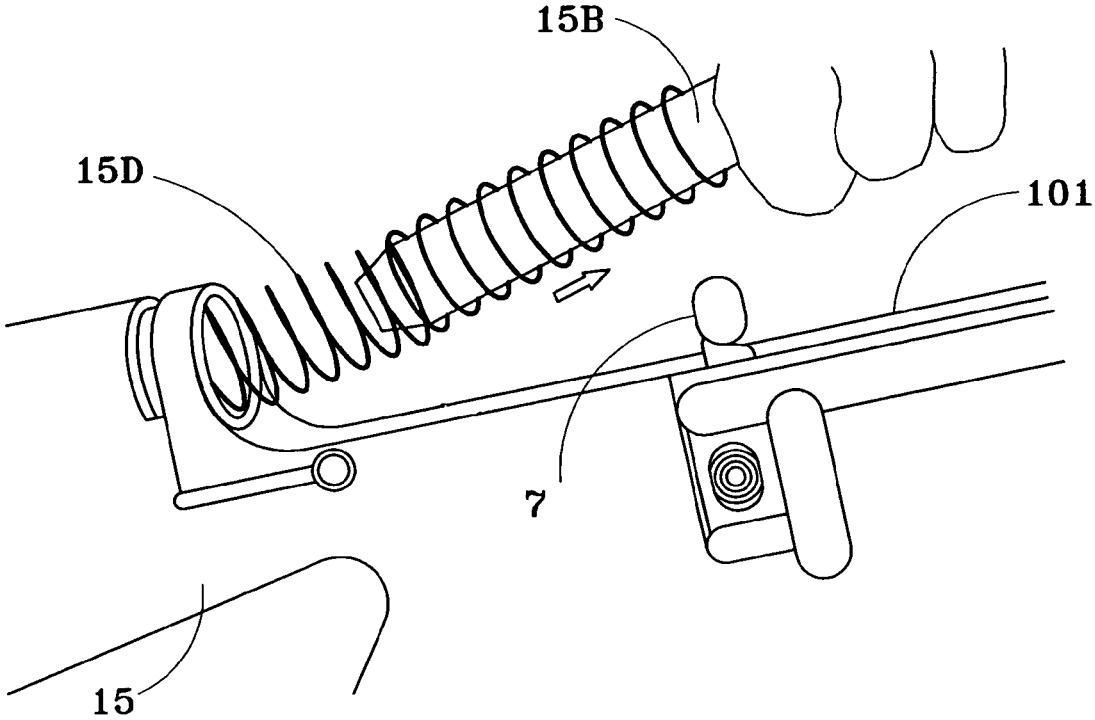
FIG. 13B depicts removal of the buffer and buffer spring therefrom.
Figure 13C:
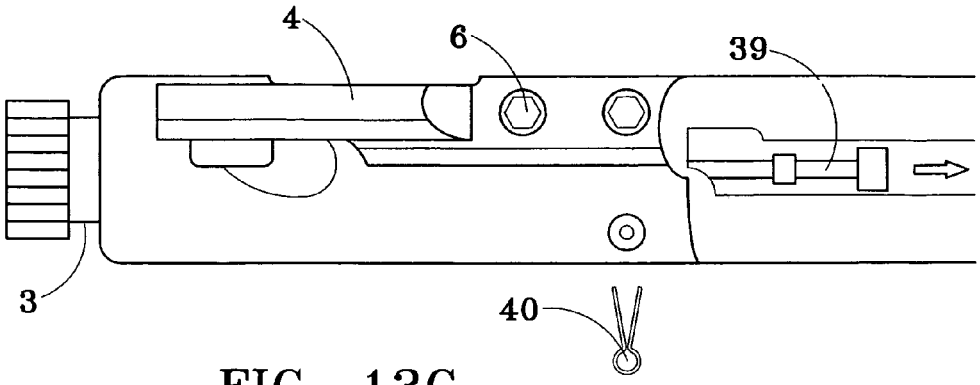
FIG. 13C depicts removal of the firing pin retaining pin from the bolt carrier of the training rifle.
Figure 13D:
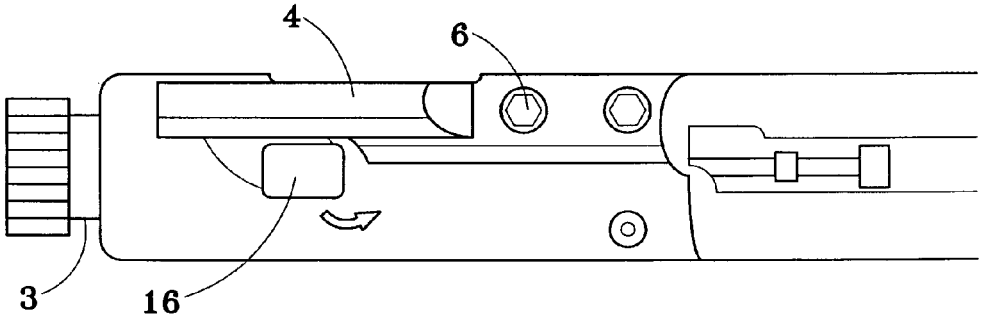
FIG. 13D depicts removal of the bolt cam pin by turning it one-quarter of a turn.
Figure 13E:
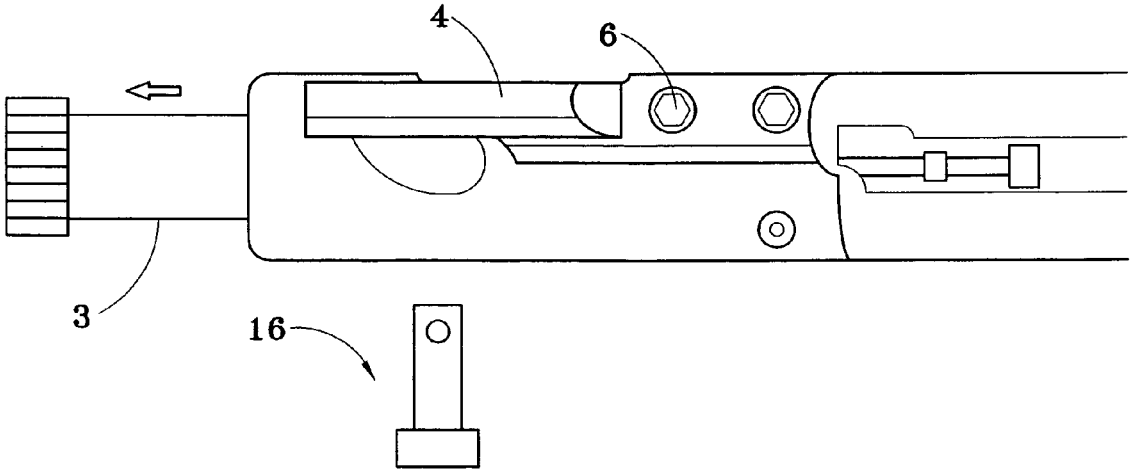
FIG. 13E depicts removal of the bolt out of the bolt carrier.
Figure 14A:
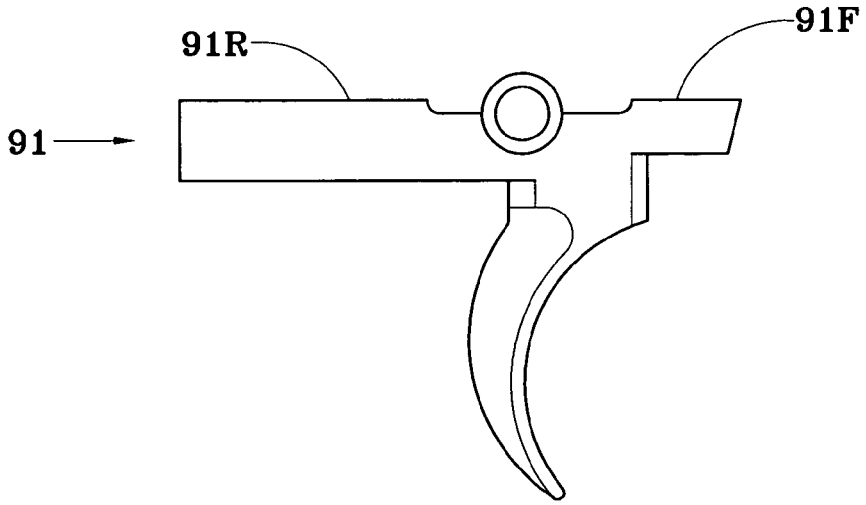
FIG. 14A (Prior Art)
FIG. 14A is a right side elevational view of the trigger of the prior art M-16 rifle.

Field stripping of the training rifle 100 proceeds as follows. The strap 61 of the rifle sling is removed from the rifle; FIG. 11A. The rifle 100 is made to stand on its buttstock 25. To remove the handguards 66, the slip-ring 316 must be depressed by another person or by use of a tool. With the slip-ring 316 depressed, one-half of handguards 66 is pried out of the delta ring assembly 302, and then the other half out as well; FIG. 11B. The rear takedown pin 88 is removed from its aperture 88A and the rifle 100 is pivoted open about the front pivot pin 74; FIG. 12A. The charging handle 20 is pulled out about half way (the bolt carrier assembly should come out with it); FIG. 12B. The bolt carrier assembly 4 is pulled out. The charging handle 20 is pulled about three-fourths of the way out and lowered out of its track; FIG. 12C. The bolt carrier assembly 4 and charging handle 20 are set aside. The front pivot pin 74 is pushed out and the upper receiver assembly 110 is separated from the lower receiver assembly 201; FIG. 1. The buffer detent 12 is pushed to release the buffer 15B and buffer spring 15D, which are then pulled out of the receiver extension tube 15C within the buffer bore 318 of the buttstock 15; FIGS. 13A, 13B. To disassemble the bolt carrier assembly 4, the bolt 3 is pushed into the carrier 4, and the firing pin retaining pin 40 is removed; FIG. 13C. The bolt cam pin 16 is removed by turning it one-fourth of a turn and then pulling it out; FIGS. 13D, 13E. The bolt 3 is then pulled out of the carrier 4; FIG. 13E. To reassemble the training rifle 100, just reverse the steps used to field strip the rifle.

From the foregoing description, it will be clear that the present invention may be embodied in other specific forms without departing from the spirit or essential characteristics thereof. Thus, the presently disclosed embodiments are to be considered in all respects as illustrative and not restrictive, the scope of the invention being indicated by the appended claims, and not limited to the foregoing description. The term "forging," wherever it appears in the claims, will be understood to include a component part of a lower receiver assembly of the kind herein described and illustrated and referred to above as a "forging," which component part may be, but need not be, comprised of forged aluminum or other metals and which may instead be fabricated by machining, molded of plastic or made by other methods known to persons of ordinary skill in the design and manufacture of semi-automatic and automatic rifle components.

Part # Part Name

| Part # | Part Name |
|---|---|
| 1 | barrel nut |
| 2 | upper receiver assembly, stripped |
| 3 | bolt |
| 4 | bolt carrier |
| 5 | bolt carrier key |
| 6 | bolt carrier key screw |
| 7 | bolt catch |
| 7S | slot in forging for bolt catch |
| 7N | pair of nibs on left wall of forging for bolt catch |
| 8 | bolt catch plunger |
| 9 | bolt catch roll pin |
| 10 | bolt catch spring |
| 11 | bolt gas rings, set |
| 12 | buffer detent |
| 13 | buffer detent spring |
| 14 | ejection port |
| 15 | buttstock |
| 15B | buttstock buffer |
| 15C | receiver extension tube |
| 15D | buffer spring |
| 15E | buttstock screw |
| 15F | stock spacer |
| 16 | cam pin |
| 17 | cap handguard front (round) |
| 18 | cap handguard front (triangular) |
| 19 | rear sight |
| 20 | charging handle |
| 21 | bolt carrier assembly |
| 22 | charging handle latch |
| 23 | charging handle latch roll pin |
| 24 | charging handle latch spring |
| 25 | delta ring |
| 26 | disconnector |
| 27 | disconnector spring |
| 28 | ejector |
| 30 | ejector spring |
| 31 | ejector roll pin |
| 32 | ejection cover |
| 33 | ejection cover spring |
| 34 | ejection cover hinge plate |
| 35 | ejection cover hinge pin clip |
| 36 | extractor |
| 37 | extractor pin |
| 38 | extractor spring with insert |
| 39 | firing pin |
| 40 | firing pin retaining pin |
| 41 | flash suppressor |
| 42 | flash suppressor lock washer |
| 44 | forward assist retainer pin |
| 45 | forward assist spring |
| 50 | gas tube |
| 61 | sling strap |
| 62 | front swivel pin |
| 63 | hammer |
| 64 | hammer and trigger pin |
| 64A | trigger pin aperture |
| 65 | hammer spring |
| 66 | handguards |
| 68 | magazine catch |
| 69 | magazine catch spring |
| 70 | magazine catch button |
| 71B | pistol grip |
| 72 | pistol grip screw |
| 73 | pistol grip screw washer |
| 74 | pivot pin, front |
| 82 | safety selector |
| 82A | aperture in forging for safety selector |
| 82B | safety selector stop |
| 88 | takedown pin |
| 83 | safety detent |
| 84 | safety spring |

-continued

| Part # | Part Name |
|---|---|
| 85 | swivel, front |
| 86 | swivel pin |
| 87 | swivel, rear |
| 88 | takedown pin, rear |
| 91 | trigger |
| 91' | pseudo-trigger |
| 91C | forging cutout for trigger |
| 95 | weld spring |
| 96 | lock ring |
| 98 | ammunition magazine |
| 101 | lower receiver forging |
| 103 | bayonet lug |
| 110 | upper receiver assembly |
| 123 | upper receiver cylindrical extension |
| 160 | barrel assembly |
| 198 | magazine well |
| 200 | barrel |
| 100 | non-firing training rifle |
| 101 | lower receiver forging of non-firing training rifle |
| 101PA | lower receiver forging of M-16 rifle |
| 201 | lower receiver assembly |
| 300 | Rear sight screw adjustment |
| 302 | delta ring assembly |
| 304 | take down pin lug |
| 306 | pivot pin lug |
| 307 | pair of apertured lugs on lower receiver forging |
| 308 | front sight |
| 310 | tubular housing of upper receiver assembly |
| 312 | charging handle track |
| 314 | carrying handle |
| 316 | slip-ring |
| 318 | buffer bore |

I claim:

1. A non-firing training rifle for training instruction in cleaning, field stripping and reassembly of an emulated rifle, which emulated rifle is either a semi-automatic or automatic rifle that includes an upper receiver assembly, barrel assembly, lower receiver assembly and ammunition magazine, comprising:

said barrel assembly of said emulated rifle, said barrel assembly extending longitudinally from a rear end and to a front end;

said upper receiver assembly of said emulated rifle, said upper receiver assembly extending longitudinally from a rear end to a front end, and said assembly having means for attaching the rear end of the barrel assembly to the front end of said upper receiver assembly;

a lower receiver assembly that extends longitudinally from a rear end to a front end, said lower receiver assembly including a pistol grip;

a buttstock that extends longitudinally from a rear end to a front end, said buttstock having a longitudinal bore;

a receiver extension tube, which tube has an externally-threaded front end and is insertable into the buffer bore;

a buffer that extends longitudinally from a rear end to a front end and is dimensioned for reciprocal sliding movement within the receiver extension tube, said buffer having an annular ridge;

a lower receiver forging, said forging having a rear portion comprising buttstock attachment means by which said forging is attached to a front end of the buttstock, said means including an upstanding, ring having an internal diameter slightly greater than the diameter of the buffer and internal threads for mating, threaded engagement with the front end of the receiver extension tube;

a front portion, said front portion including transversely spaced-apart, vertical left and right walls of equal size joined by a first vertical front wall, and a central portion intermediate the rear and front portions, said central portion including longitudinally-extended left and right walls of equal size joined by a second vertical front wall, a flat, horizontal top wall, a bottom wall, and the buttstock attachment means, said bottom wall having a trigger access cutout, thereby defining a substantially closed interior space, means for attaching an upper portion of the pistol grip to a lower, rear portion of the forging, a trigger guard that depends from the bottom wall of the forging, means for attaching an upper portion of said forging to a lower portion of the upper receiver assembly, and wherein the first wall and the front, left and right walls of the front portion of the lower receiver assembly cooperate with the second front wall of the central portion of the lower receiver assembly to define a magazine well for insertion of an ammunition magazine;

a pseudo-trigger pivotally mounted to the forging by a transverse trigger pin and disposed within the trigger guard, and a safety selector switch mounted on a side wall of the lower receiver assembly above the pistol grip and to the rear of the trigger, said switch including a thumb-actuable indicating lever rotatable alternately between a "fire" position and a "safe" position.

2. The training rifle of claim 1, further comprising an ammunition magazine dimensioned and adapted for insertion into the magazine well, and magazine catch means mounted to the forging for alternately locking the magazine within the magazine well and releasing the magazine from the well.

3. The training rifle of claim 2, wherein the left and right walls of the central portion of the lower receiver forging are apertured, a lower, rear portion of the upper receiver assembly has a depending, rear apertured lug, and the means for attaching an upper portion of the lower receiver forging to a lower portion of the upper receiver assembly includes a rear take-down pin insertable through an aperture in said lug and through the apertures in the left and right walls of said central portion when said apertures are aligned.

4. The training rifle of claim 3, wherein the left and right walls of the front portion of the lower receiver forging are apertured, a lower, front portion of the upper receiver assembly has a depending, front apertured lug, and the means for attaching an upper portion of the lower receiver forging to a lower portion of the upper receiver assembly includes a front pivot pin insertable through an aperture in said lug and through the apertures in the left and right walls of said front portion when said apertures are aligned, and wherein the bottom wall of the forging has a recess to receive said front apertured lug.

5. The training rifle of claim 4, wherein the means for attaching the front end of the upper receiver assembly to the rear end of the barrel assembly includes a hollow, cylindrical, threaded extension at a front end thereof, and the barrel assembly includes a barrel having a straight, cylindrical bore that extends longitudinally from a rear end to a front end;

a front sight mounted on a front portion of the barrel;

upper and lower hand guards mounted on an exterior surface of the barrel that extend longitudinally part way from the rear end of the barrel assembly toward the front end thereof, each guard having a rear end and a front end;

a slip-ring insertable over the barrel between the front sight and the front ends of the hand guards for securing the hand guards to the barrel;

and a barrel extension that is coaxial with the barrel and extends from a rear end of the barrel into the threaded extension of the upper receiver.

6. The training rifle of claim 5, wherein the barrel assembly further includes a front sling swivel that depends from the barrel, and further comprising a rear sling loop that depends from a rear end portion of the buttstock.

7. The training rifle of claim 6, wherein the barrel assembly further includes a flash suppressor attached to the front end of the barrel.

8. The training rifle of claim 7, further comprising a rifle sling for mounting the rifle on a shoulder of a rifleman, said sling having a front end attachable to the front sling swivel and a rear end attachable to the rear sling loop.

9. The training rifle of claim 8, wherein the training rifle emulates an M-16 rifle and at least the following are component parts of the training rifle and are identical to the same component parts of an M-16 semi-automatic or automatic rifle: upper receiver assembly, bolt and bolt carrier assembly, bolt catch, bolt catch spring, magazine catch, barrel assembly (except the rifle barrel), buttstock, buffer, buffer detent, buffer detent spring, buffer spring, receiver extension, ammunition magazine, pistol grip, means for attaching an upper portion of the lower receiver assembly to a lower portion of the upper receiver assembly, means for attaching an upper portion of the pistol grip to a lower, rear portion of the lower receiver assembly, front sight, upper and lower hand guards, slip-ring, barrel extension and flash suppressor, and safety selector.

10. A lower receiver forging for use in a training rifle that emulates a semi-automatic or automatic rifle, said emulated rifle including an upper receiver assembly, bolt and bolt carrier assembly, a lower receiver assembly that includes a buttstock having a longitudinal bore, and an ammunition magazine, said training rifle including an upper receiver assembly, a barrel assembly, a buttstock having a longitudinal buttstock bore, a receiver extension tube that is insertable into said buttstock bore and having an externally-threaded front end, a buffer reciprocally slidable within said tube and urged in forward direction within the bore by a buffer spring that engages an annular ridge of the buffer, a buffer detent for holding the buffer and buffer spring within the tube and for selectively releasing the buffer and buffer spring from said tube, a pistol grip, and an ammunition magazine, said forging comprising:

a rear portion comprising buttstock attachment means by which said forging is attachable to a front end of a buttstock of the training rifle, said means including an upstanding ring having an internal diameter slightly greater than the diameter of the buffer and internal threads for mating engagement with the threaded front end of the receiver extension tube;

a front portion, said front portion including transversely spaced-apart, vertical left and right walls of equal size joined by a first vertical front wall, and a central portion intermediate the rear and front portions, said central portion including longitudinally-extended left and right walls of equal size joined by a second vertical front wall, a flat, horizontal top wall, a bottom wall, and the buttstock attachment means, said bottom wall having a trigger access cutout, thereby defining a substantially closed interior space, means for attaching an upper portion of the pistol grip to a lower, rear portion of the forging, a trigger guard that depends from the bottom wall of the forging, means for attaching an upper portion of said forging to a lower portion of the upper receiver assembly;

wherein the first front wall and the left and right walls of the front portion of the lower receiver assembly cooperate with the second front wall of the central portion of the lower receiver assembly to define a magazine well for insertion of an ammunition magazine.

11. The forging of claim 10, wherein an upper end portion of the pistol grip has a recess and the means for attaching an upper portion of the pistol grip to a lower, rear portion of the forging is a longitudinally-disposed plate 190 that depends from the bottom wall of the central portion of the forging, which plate appears substantially trapezoidal in left and right side elevational views thereof and is dimensioned to be received by said recess, and a lower portion of said plate has an internally-threaded aperture for attachment to the pistol grip by a threaded fastener.

12. The forging of claim 11, wherein the left and right walls of the central portion of the lower receiver forging are apertured, a lower, rear portion of the upper receiver assembly has a depending, rear apertured lug, and the means for attaching an upper portion of the lower receiver forging to a lower portion of the upper receiver assembly includes a takedown pin insertable through apertures in said lug and left and right walls of said central portion when said apertures are aligned.

13. The forging of claim 12, wherein the left and right walls of the front portion of the lower receiver forging are apertured, a lower, front portion of the upper receiver assembly has a depending, front apertured lug, and the means for attaching an upper portion of the lower receiver forging to a lower portion of the upper receiver assembly includes a front pivot pin insertable through apertures in said lug and left and right walls of said front portion when said apertures are aligned, and wherein the top wall of the forging has a recess to receive said front apertured lug.

14. The forging of claim 13, wherein the emulated rifle is an M-16 rifle.

* * * * *